US006860775B2

(12) United States Patent
Buzzetti

(10) Patent No.: US 6,860,775 B2
(45) Date of Patent: Mar. 1, 2005

(54) ANTI-EXPOSURE FLOTATION SUIT

(76) Inventor: Dave Buzzetti, 1925 Spike Pl., Alpharetta, GA (US) 30005

( * ) Notice: Subject to any disclaimer, the term of this patent is extended or adjusted under 35 U.S.C. 154(b) by 0 days.

(21) Appl. No.: 10/617,071

(22) Filed: Jul. 10, 2003

(65) Prior Publication Data

US 2004/0053549 A1 Mar. 18, 2004

Related U.S. Application Data

(60) Provisional application No. 60/395,504, filed on Jul. 11, 2002.

(51) Int. Cl.[7] ..... B63C 9/08

(52) U.S. Cl. ..... 441/88; 441/105; 441/104; 441/103

(58) Field of Search ..... 2/2.14–2.17, 269; 441/102–105, 88

(56) References Cited

U.S. PATENT DOCUMENTS

| | | | | | |
|---|---|---|---|---|---|
| 261,318 | A | * | 7/1882 | Dobbs | 2/269 |
| 1,061,808 | A | * | 5/1913 | Blackwell | 441/104 |
| 1,102,772 | A | * | 7/1914 | Lyman | 441/104 |
| 1,252,842 | A | | 1/1918 | Richardson | |
| 1,752,120 | A | * | 3/1930 | Taylor | 441/105 |
| 2,782,430 | A | | 2/1957 | Radnofsky | |
| 2,911,649 | A | * | 11/1959 | Ruelle et al. | 2/69.5 |
| 3,354,480 | A | | 11/1967 | Harding et al. | |
| 3,441,963 | A | | 5/1969 | Steinthal | |
| 3,497,889 | A | | 3/1970 | Mellin et al. | |
| 4,052,762 | A | | 10/1977 | Zawislak | |
| 4,136,402 | A | | 1/1979 | Insulan et al. | |
| 4,242,769 | A | | 1/1981 | Rayfield et al. | |
| 4,276,670 | A | | 7/1981 | Marchello et al. | |
| 4,308,629 | A | | 1/1982 | Freemon | |
| 4,416,641 | A | | 11/1983 | Spinosa et al. | |
| 4,533,335 | A | | 8/1985 | Hoshino | |
| 4,563,157 | A | | 1/1986 | Hoshino | |
| 4,704,092 | A | | 11/1987 | Liukko | |
| 4,734,072 | A | * | 3/1988 | Lastnik | 441/105 |
| 4,767,371 | A | | 8/1988 | Jackson | |
| 5,413,485 | A | | 5/1995 | Adee | |
| D359,097 | S | | 6/1995 | Crandall et al. | |
| D379,397 | S | | 5/1997 | McMahon | |
| 6,260,199 | B1 | | 7/2001 | Grunstein et al. | |

* cited by examiner

*Primary Examiner*—Ed Swinehart
(74) *Attorney, Agent, or Firm*—Robert L. Wolter; Beusse Brownlee Wolter Mora & Maire, P.A.

(57) ABSTRACT

An anti-exposure flotation suit for children is fabricated from water impermeable fabrics, and is sealed at various openings to prevent water from leaking into the enclosed interior. Elongated sleeves and a bottom of the suit are enclosed to prevent water leakage. A watertight zipper may be used to close an opening through which a child is placed for donning the suit. A flexible collar and hood seals the neck area from water leaking into the suit. The length of the sleeves and suit are adjustable to fit various sizes of children.

19 Claims, 2 Drawing Sheets

ANTI-EXPOSURE FLOTATION SUIT

This application claims priority of Provisional Patent Application Ser. No. 60/395,504, filed on Jul. 11, 2002.

BACKGROUND OF THE INVENTION

The present invention relates, generally, to flotation devices and anti-exposure suits. More specifically, the invention pertains to such suits that are adapted for use by children.

Current garments provide some element of flotation, a method of thermal protection, or in some cases, a combination of the two. In any event, none offer the combination of anti-exposure and flotation in a quick-donning and adjustable garment specifically designed for infants and small children.

Regulatory agencies of both aviation and cruise line industries have made steps toward requiring minimum performance standards for infant flotation devices. The Federal Aviation Administration ("FAA"), Canadian Aviation Regulations and the International Council of Cruise Lines ("ICCL") require the use of specific infant flotation garments that provide whole-body protection from hypothermia. However, Britain's Civil Aviation Authority ("CAA" and the FAA's Civil Aeromedical Institute ("CAMI") have determined that original versions of these devices could not be relied upon to accommodate infants over the age of three months. This is because infants have, on average, become progressively larger and because the approved equipment is smaller than previously thought. Additionally, most infant life jackets are designed for use by infants over the age of twelve months and, therefore, cannot be relied upon to accommodate infants younger than this age. They (CAA and CAMI) further identified the existence of a "nine-month" gap for infants between the ages of three to 12 months, where current flotation garments do not fit properly. The ICCL and the U.S. Coast Guard recognize that there are no Safety of Life at Sea ("SOLAS") approved or USCG approved Type 1 life jackets for persons weighting less than 30 pounds. Therefore, life jackets approved for other purposes, like the aviation approved infant baby cots, may be utilized to meet this requirement.

Current versions of infant life preservers are of the "baby cot" or "survival capsule" design. These are basically one-person life rafts for infants up to age 18 months. While providing the required level of protection, the design of these systems require inflation of a rather large structure prior to placing the child inside. Even with the standard $CO_2$ inflation mechanism inflating the exterior structure, some of them still require oral inflation of the floor of the device, thereby prolonging the donning time and adding an element of confusion to donning procedures. Outcome studies conducted at CAMI's Aircraft Cabin Evacuation Facility have concluded that post-crash survival is only possible within the first 90 seconds before the non-survivable "flashover" effect occurs, so any delay in emergency egress could potentially lead to disastrous consequences.

The current invention will provide a flotation property, a means of keeping the infant apart from the water and a means of mitigating the chilling effects of a wind. The design will satisfy all the requirements of both aviation and cruise line industries in a small and adjustable quick-donning anti-exposure flotation ensemble that facilitates donning and expedites egress under emergency situations.

SUMMARY OF THE INVENTION

The present invention for an anti-exposure flotation suit for children comprises a suit fabricated from water impermeable fabrics and encloses and seals a child within the suit to prevent exposure to the ambient environment. The suit may comprise a torso section having a neck opening, an enclosed bottom end and two elongated sleeves extending from the torso section having enclosed ends distal the torso section. Means are operatively connected to the suit for adjustment of a length of each sleeve and a length of the torso section. An opening is disposed along the torso section for placing a child in the suit, and means are connected to the suit for closing the opening once the child is placed in the suit is connected to the suit and opening. In a preferred embodiment, the length of the sleeves and torso section are adjustable.

BRIEF DESCRIPTION OF THE DRAWING

For a better understanding of the invention, reference is made to the following detailed description taken in conjunction with the accompanying drawings in which.

DETAILED DESCRIPTION OF THE DRAWINGS

Figure 1:
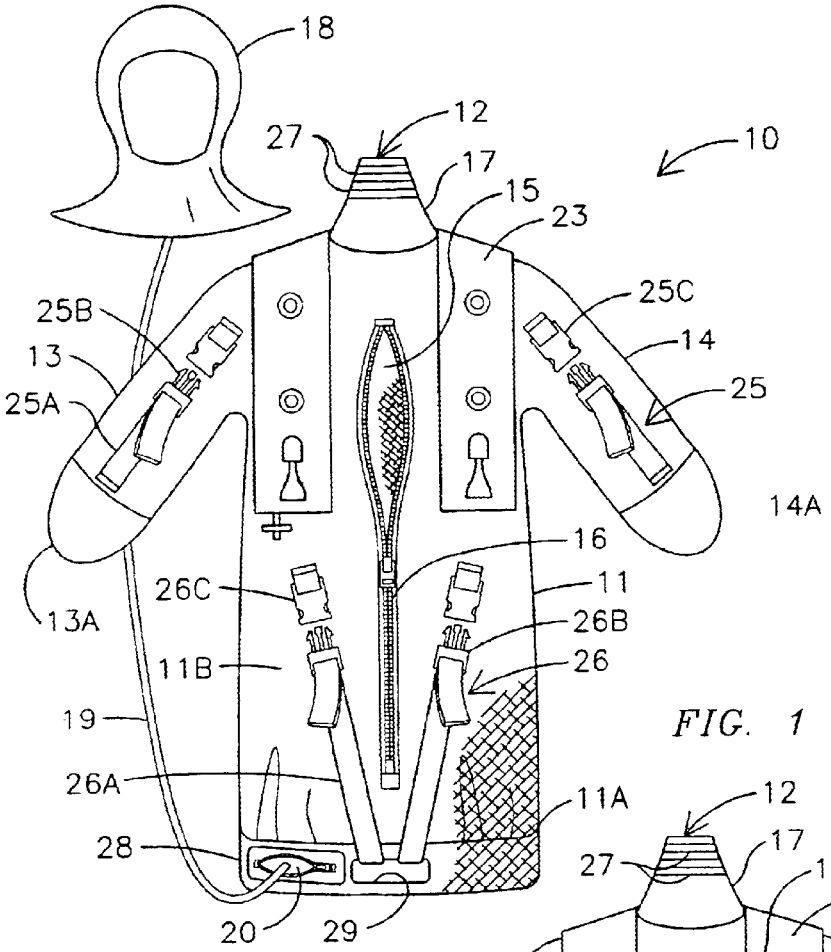
FIG. 1 is the anti-exposure flotation ensemble of the invention in front elevation.
Figure 2:
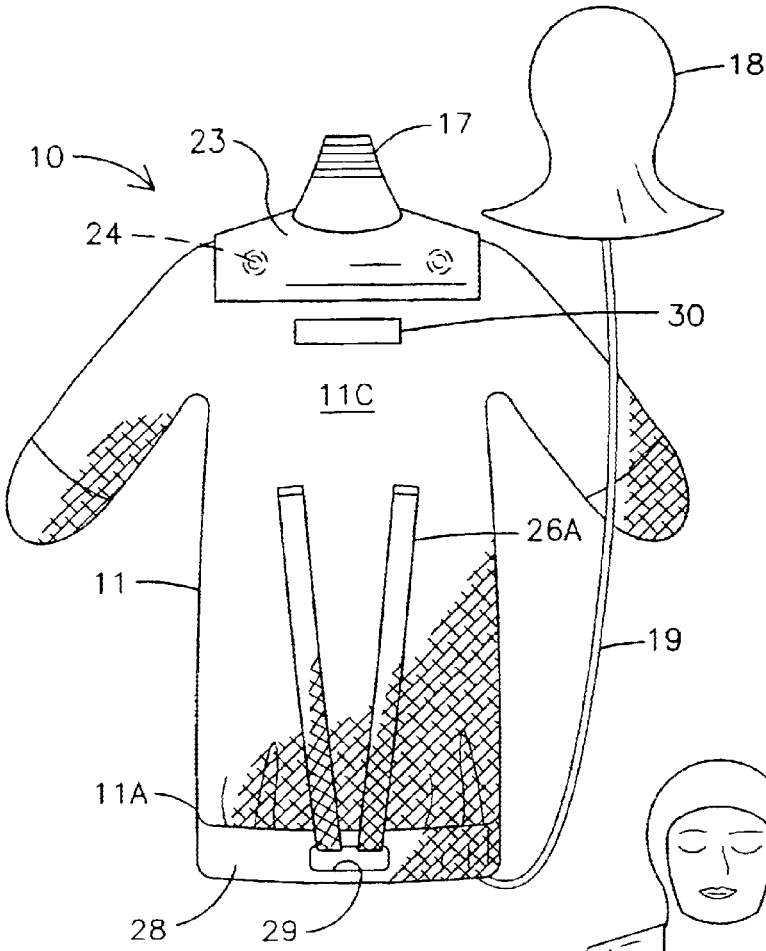
FIG. 2 is the garment in rear elevation.

The present invention for an anti-exposure flotation suit 10 is illustrated in FIG. 1 and FIG. 2, which suit 10 comprises a torso section 11, elongated sleeves 13 and an opening 12 for the neck and head of a child. In a preferred embodiment, he suit 10 is composed of at least one layer of a fire-resistant aramid cloth, Gortex™, a welded nylon known as Nonex® or a combination of Gortex™ and nylon or similar water impermeable or waterproof fabric, and is designed in a bunting bag-like configuration that is enclosed at the extremities of a child.

Figure 3:
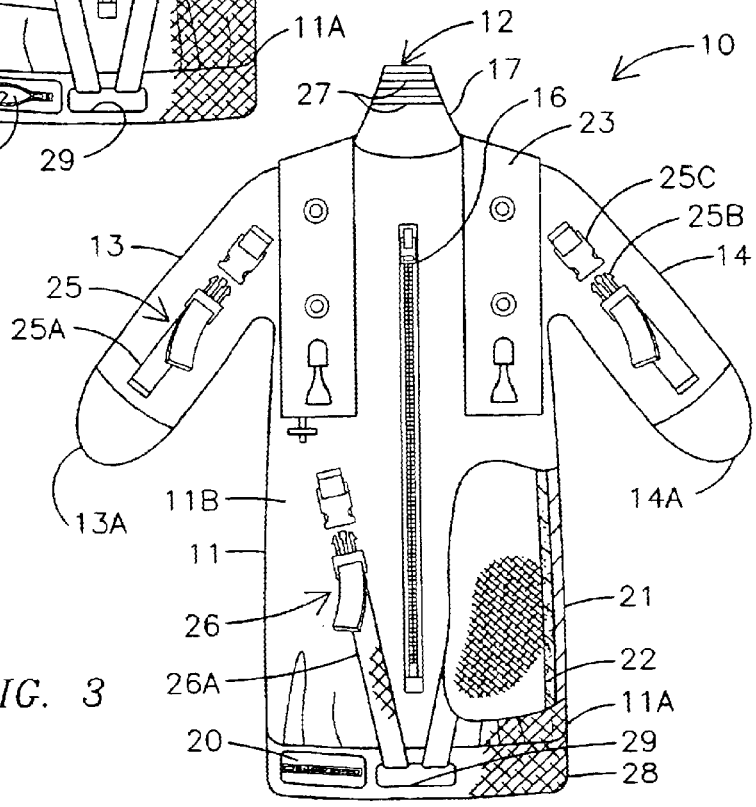
FIG. 3 is a front sectional view showing the lining interior.

With respect to FIG. 3, the suit 10 may comprise an outer water impermeable layer 21 and an additional inner lining 22 that insulates an interior of the suit 10. The suit 10 is completely lined providing protection from the thermal effects of cold water immersion. The interior lining 22 is attached to the inside surface of the outer layer 21 at appropriate points to prevent slippage and eliminates the need for an internal zipper, when donning. There are numerous materials and layering techniques that can be selected for the lining 22. Materials include, but are not limited to, natural or synthetic fabrics, such as 100% cotton, polypropylene netting or 100% olefin microfiber thermal insulation, a closed cell fabric such as Airsoft™, or combinations thereof.

With respect to FIG. 1, a front or anterior portion 11A is shown of the torso section 11. The sleeves 13 and 14 are elongated and enclosed to completely cover the child's shoulder, arms, hands and fingers. Accordingly, each sleeve 13 and 14 includes a closed end 13A, 14A distal the sleeve attachment to the torso section 11. Similarly, a bottom end 11A of the torso section 11 is enclosed to prevent exposure of the child's feet and legs to the ambient environment. As mentioned above, in a preferred embodiment, the suit 10 has a bag-like configuration, so the bottom end 11A has a substantially linear closed end, or no protrusions within which to insert a child's legs.

An opening 15 is disposed along the anterior portion 11A of the torso section 11, as shown in FIG. 1, through which a child is placed in the suit 10. Alternatively, the opening may be disposed along other portions of the torso section 11 such as the posterior portion 11B, shown in FIG. 2. The suit 10 is also equipped with a means, operatively connected to the suit 10, for closing the opening 15 once a child is placed in the suit 10 through the opening 15. Such closing means should be constructed to seal an interior of the suit 10 from the ambient environment. Accordingly, watertight zippers 16, known to those skilled in the art, are available for similar suits used in wet suits and/or dry suits for diving. In addition to, or alternatively, Velcro™ attachments may be used with a flap system to seal the opening 15.

A flexible collar 17 is attached to a top end 11B of the torso section 11 forming the opening 12 through which a child's head and neck fits. Once the child is placed into the suit through opening 15 and the neck opening 12, the zipper 16 is adjusted to close the opening 15 and seal the child within the suit 10. The collar 17 may also include fitting lines 27 to cut the collar to adjust the size of the opening 12 to snugly fit the neck of the child. The collar 17 may be constructed of neoprene rubber or other similar sealing material that is sufficiently flexible to allow the child's head and neck to slip through the collar 17.

A hood 18 may be attached to the suit 10 by a tether 19, as shown in FIGS. 1 and 2. The hood 18 may be fabricated from a material similar in flexibility, sealing capacity and thickness as the collar 17. The tether 19 is fixed to the hood 18 at one end and to the extension 29 at the other end, which extension 29 depends from the bottom end 11A of the torso section 11. A pocket 20 is formed in the extension 29 for storage of the hood 18. The hood 18 is placed on the child once the child is fitted within the suit 10, as shown in FIG. 4.

A flotation device 23 may be attached to both the anterior portion 11B and posterior portion 11C of the suit 10, as shown in FIGS. 1 and 2. The flotation device 23 may be attached by conventional means, such as locking snaps 24, nylon ties or Velcro™ loops to secure the flotation device 23 to the suit 10. Other methods of attachment may be used, for example, the flotation device 23 may be integrally sewn into the outer layer of the suit 10. The flotation device 23 may be automatically inflatable using $CO_2$ cartridges (not shown) and tubes (not shown) for alternative manual inflation. The suit may also be equipped with an emergency beacon that is known to those skilled in the art and produces a signal (visual or audio) when activated.

Figure 4:
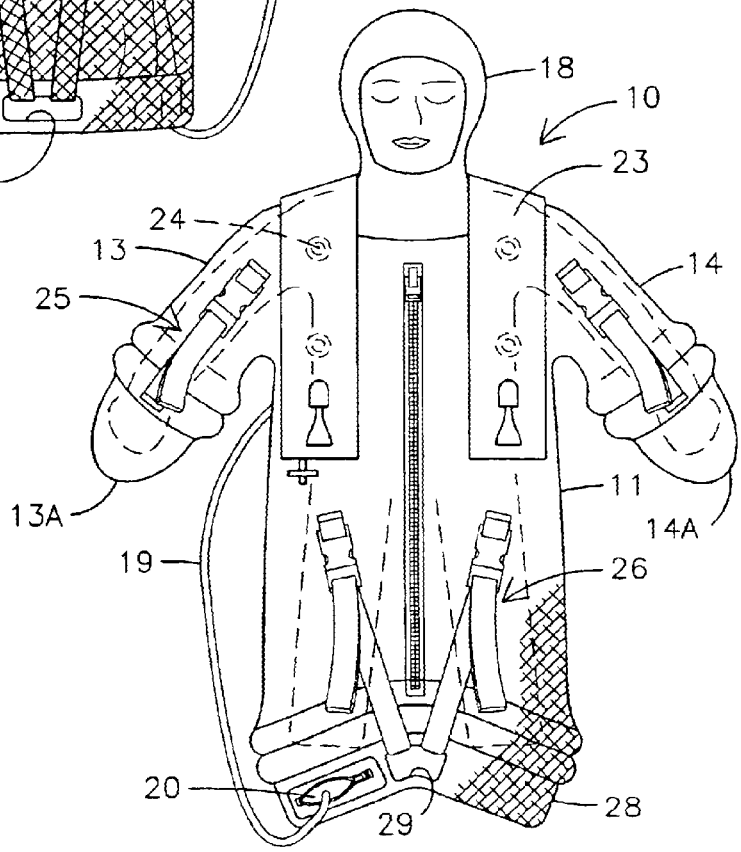
FIG. 4 is a front perspective with the garment donned on a child.

As shown in FIG. 4, once a child is fitted within the suit 10, the length of the sleeves 13 and 14 and torso section 11 are adjusted to snugly fit the child within the suit 10. The suit 10 comprises means for adjustment of the length of the sleeves 13 and 14, and the torso section 11. The adjustment means may include a strap and buckle mechanism 25 and 26 for adjustment of the lengths of the sleeves 13 and 14 and torso section 11, respectively. With respect to the sleeve adjustment means, a strap 25A is affixed towards the closed ends 13A and 14A of the sleeves 13 and 14, and has a male connector 25B at an opposite end. A female connector 25C is attached to the sleeves 13 and 14 towards the torso section 11 for receiving the male connector 25B.

The torso adjustment means, as shown in FIGS. 1 and 2, includes straps 26A that are affixed to the posterior portion 11C of the torso section 11, and engage a bottom 11A of the torso section 11. In the particular embodiment shown in FIGS. 1 and 2, the extension 28 is affixed to the bottom end 11A of the torso section 11. The extension 28 may be constructed of a waterproof material similar to the outer layer 21 of the suit 10. A slot 29 is formed in the bottom extension 28 so the straps 26A extend from the posterior portion 11C through the slot 29 and towards the anterior portion 11B of the torso section 11. Female connectors 26C are attached to the anterior portion 11B for receipt of the male connector 26B for attachment and adjustment of the length of the torso section 11, as shown in FIG. 4. In this manner, the suit 10 provides an insulated, water impermeable device that protects the child from exposure to the elements and drowning, and can be adjusted to fit different sizes of children.

As shown in FIG. 2, a rescue handle 30 provides a means for water extrication. The rescue handle 30 may be constructed of nylon webbing material preferably sewn on the posterior portion 11C at an area between the shoulders of a child.

While the preferred embodiments of the present invention have been shown and described herein, it will be obvious that such embodiments are provided by way of example only and not of limitation. Numerous variations, changes and substitutions will occur to those of skilled in the art without departing from the teaching of the present invention. Accordingly, it is intended that the invention be interpreted within the full spirit and scope of the appended claims.

I claim as my invention:

1. An anti-exposure flotation suit for children comprising:

(a) a torso section having a neck opening and a substantially linear enclosed bottom end forming a bag configuration;

(b) two elongated sleeves extending from the torso section having enclosed ends distal the torso section;

(c) means, operatively to connected to the suit, for adjustment of a length of the torso section;

(d) an opening in the torso section through which a child fits for placing the suit thereon;

(e) means, connected to the suit, for closing the opening once a child is placed in the suit; and, (f) a floatation device attached to the torso section of the suit.

2. The suit of claim 1 having a means for adjusting the sleeves, wherein the means for adjusting the length of the sleeves comprises a strap engaging the enclosed end of the sleeve and operatively connect to a buckle attached to the sleeve toward the torso section of the suit.

3. An anti-exposure flotation suit for children comprising:

a. a torso section having a neck opening and an enclosed bottom end;

b. two elongated sleeves extending from the torso section having enclosed ends distal the torso section;

c. means, operatively to connected to the suit, for adjustment of a length of the torso section wherein the means for adjusting the length of the torso section comprises at least one strap engaging the bottom end of the torso section and operatively connected to a buckle attached to the torso section of the suit;

d. an opening in the torso section through which a child fits for placing the suit thereon;

e. means, connected to the suit, for closing the opening once a child is placed in the suit;

f. a floatation device attached to the torso section of the suit; and g. an extension depending from the bottom end of the suit, and the at least one strap engaging the extension and operatively connected to a buckle attached to t e torso section of the suit.

4. The suit of claim 3 further comprising a slot disposed along the extension and said at least one strap has a first end attached to a posterior portion of the suit and extends through the slot and is operatively connected to a buckle attached to an anterior portion of the suit.

5. The suit of claim 1 further comprising a hood and a tether connecting the hood to the suit.

6. The suit of claim 1 further comprising a carbon dioxide cartridge operatively connected to the floatation device to inflate the floatation device.

7. The suit of claim 1 wherein said flotation device comprises at least one tube for manual inflation of the floatation device.

8. An anti-exposure flotation suit for children comprising (a) a torso section having a neck opening and an enclosed bottom end and the suit having a baa configuration;

(b) two elongated sleeves extending from the torso section having enclosed ends distal the torso section;

(c) an opening in the torso section through which a child fits for placing the suit thereon;

(d) means, connected to the suit, for closing the opening once a child is placed in the suit;

(e) a floatation device attached to the torso section of the suit; and (f) means, operatively connected to the suit for adjusting the length of the torso section by adjusting the closed end upward toward the child.

9. The suit of claim 8 further comprising means, operatively to connected to the suit, for adjustment of a length of each sleeve.

10. The suit of claim 9 wherein the means for adjusting the length of the torso section comprises at least one strap engaging the bottom end of the torso section and operatively connected to a buckle attached to the torso section of the suit.

11. An anti-exposure flotation suit for children comprising:

(a) a torso section having a neck opening and an enclosed bottom end;

(b) two elongated sleeves extending from the torso section having enclosed ends distal the torso section;

(c) an opening in the torso section through which a child fits for placing the suit thereon;

(d) means, connected to the suit, for closing the opening once a child is placed in the suit;

(e) a floatation device attached to the torso section of the suit: and (f) an extension depending from the bottom end of the suit, and the means for adjusting the length of the torso section comprises at least one strap engaging the extension and operatively connected to a buckle attached to the torso section of the suit.

12. The suit of claim 11 further comprising a slot disposed along the extension and said at least one strap has a first end attached to a posterior portion of the suit and extends through the slot and is operatively connected to a buckle attached to an anterior portion of the suit.

13. The suit of claim 8 further comprising a hood and a tether connecting the hood to the suit.

14. The suit of claim 8 further comprising a carbon dioxide cartridge operatively connected to the floatation device to inflate the floatation device.

15. The suit of claim 8 wherein said flotation device comprises at least one tube for manual inflation of the floatation device.

16. A method of protecting a child from exposure and drowning comprising the steps of:

(a) providing a water impermeable suit having a torso section, a head and neck opening and elongated sleeves;

(b) enclosing an end of the sleeves distal the torso section;

(c) enclosing a bottom end of the torso section to form a bag configuration for the torso section;

(d) attaching a flotation device to the torso section of the suit; and (e) providing an opening in the torso section through which a child may be fitted into the suit.

17. The method of claim 16 further comprising the step of providing a means, operatively connected to the suit, for adjusting a length of the sleeves.

18. The method of claim 16 further comprising the step of providing means, operatively connected to the suit, for adjusting the length of the torso section.

19. The method of claim 16 further comprising the step of providing a watertight seal at the opening in the torso section.

* * * * *